United States Patent [19]

Arginsky

[11] Patent Number: 4,498,627

[45] Date of Patent: Feb. 12, 1985

[54] SPRAY HOOP

[75] Inventor: Richard C. Arginsky, Ellenville, N.Y.

[73] Assignee: Master Juvenile Products, Ellenville, N.Y.

[21] Appl. No.: 412,956

[22] Filed: Aug. 30, 1982

[51] Int. Cl.[3] ..... B05B 15/06

[52] U.S. Cl. ..... 239/279; 239/289; 239/567

[58] Field of Search ..... 239/273, 275, 279, 285, 239/289, 567; 4/596, 597, 615, 616, 660, 661; D23/7, 10, 13; D21/101; 46/91; 272/1 B, 74

[56] References Cited

U.S. PATENT DOCUMENTS

| | | | |
|---|---|---|---|
| D. 35,074 | 9/1901 | Hull . | |
| D. 167,307 | 7/1952 | Ficken | D91/1 |
| D. 194,920 | 4/1963 | Darling | D34/5 |
| D. 210,074 | 2/1968 | Da Prato | D23/10 |
| D. 245,915 | 9/1977 | Pearson | D23/7 |
| 273,940 | 3/1883 | Bonninghausen | D23/7 |
| 648,263 | 4/1900 | Hull . | |
| 1,758,767 | 5/1930 | Taggart . | |
| 2,566,781 | 9/1951 | Tetzlaff | 239/273 |
| 2,580,629 | 1/1952 | Wenzel . | |
| 2,665,171 | 1/1954 | Stievater . | |
| 2,791,466 | 5/1957 | Crisp | 239/567 |
| 2,829,379 | 4/1958 | McGee . | |
| 2,954,932 | 10/1960 | Albano | 239/188 |
| 3,170,171 | 2/1965 | Mayhew et al. | 239/567 |
| 3,322,347 | 5/1967 | Pierce . | |
| 3,363,268 | 1/1968 | Friedlander | 4/172 |
| 3,539,181 | 11/1970 | Larsen . | |
| 3,679,136 | 7/1972 | Snyder . | |
| 4,124,206 | 11/1978 | Price | 239/280 |

*Primary Examiner*—Andres Kashnikow
*Assistant Examiner*—Michael J. Forman
*Attorney, Agent, or Firm*—Lerner, David, Littenberg, Krumholz & Mentlik

[57] ABSTRACT

A spray hoop has a hollow base capable of holding enough water to stabilize the spray hoop as water flows therethrough along a generally circular path which includes the base and a hoop-shaped hose connected to the base in a generally vertical position so that individuals, such as children, may run therethrough. The hose includes a plurality of orifices spaced at intervals along an inner circumferential surface of the hose. Each of the orifices directs water radially inward relative to the hoop-shaped hose to spray individuals running through the spray hoop.

4 Claims, 4 Drawing Figures

SPRAY HOOP

FIELD OF THE INVENTION

The present invention relates to a spray hoop and, more particularly, to such a hoop which is large enough for an individual, such as a child, to run through while being sprayed with water discharged therefrom.

BACKGROUND OF THE INVENTION

During hot seasons, individuals, especially children, will often run through the spray of a cnventional lawn sprinkler in order to cool off. Also, it is common for children to wet each other with the spray of a standard garden hose in order to cool themselves off on hot days.

In the past, spray hoops have been proposed which can be placed on a lawn or some other playground (see U.S. Pat. Nos. Des. 210,074; 2,665,171 and 3,170,171). These spray hoops include a water-spraying tube having a generally oval shape (see U.S. Pat. No. Des. 210,074) a U shape (see U.S. Pat. No. 2,665,1717) or a keyhole shape (see U.S. Pat. No. 3,170,171). The variously shaped tubes are sized such that an individual can run therethrough while being sprayed by the water discharged therefrom. Thus, the spray hoops function as recreational devices for individuals who may use them in place of a garden hose or lawn sprinkler for the purpose of cooling off on hot days.

The prior spray hoops suffer from several disadvantages. For instance, the spray hoop illustrated in U.S. Pat. No. Des. 210,074 is provided with a spike for mounting purposes. In addition to being dangerous, the spike limits the spray hoop to use on lawns or other relatively soft surfaces. The spray hoops disclosed in U.S. Pat. Nos. 2,665,171 and 3,170,171 employ bases which can be mounted on hard surfaces as well as soft surfaces. However, the bases of these spray hoops are relatively large and cumbersome, thereby complicating shipment, storage, and handling.

All of the prior spray hoops are equipped so as to be supplied with water from a standard garden hose. However, none of these spray hoops is provided with equipment for regulating or adjusting the flow of water therethrough.

SUMMARY OF THE INVENTION

The problems and disadvantages of the prior art spray hoops discussed above are overcome by providing a spray hoop with a hollow base adapted to receive enough water to stabilize the spray hoop without resorting to an oversized base or to additional stabilizing devices, such as spikes, anchors, etc. The spray hoop also includes a hoop-shaped hose which is in constant fluid communication with the base, whereby water supplied to the spray hoop flows along a generally circular path which includes the hose and the base. The hose has a plurality of orifices spaced at intervals along an inner circumferential surface of the hose. Each of the orifices directs water radially inward relative to the hoop formed by the hose to spray anyone who runs or otherwise passes through the hoop. Because the base and the hoop are in constant fluid communication, the base is automatically filled with water during the use of the spray hoop.

In one embodiment, the base includes a water inlet which is provided with a manually adjustable valve for adjusting the flow of water through the spray hoop. Because the valve forms an integral part of the spray hoop, the flow of water through the spray hoop can be quickly and easily adjusted independently of the water source. Thus, if the water source is a faucet which has already been opened, the flow of water through the spray hoop can be adjusted without any further opening or closing of the faucet.

The hose is attached to the base such that it assumes a generally vertical position. If the hose is too flexible to be freestanding, the spray hoop is provided with a locking device adapted to maintain the hose in a generally vertical position.

BRIEF DESCRIPTION OF THE DRAWINGS

For a more complete understanding of the present invention, reference is made to the following description of an exemplary embodiment considered in conjunction with the accompanying drawings, in which.

DESCRIPTION OF THE EXEMPLARY EMBODIMENT

Figure 1:
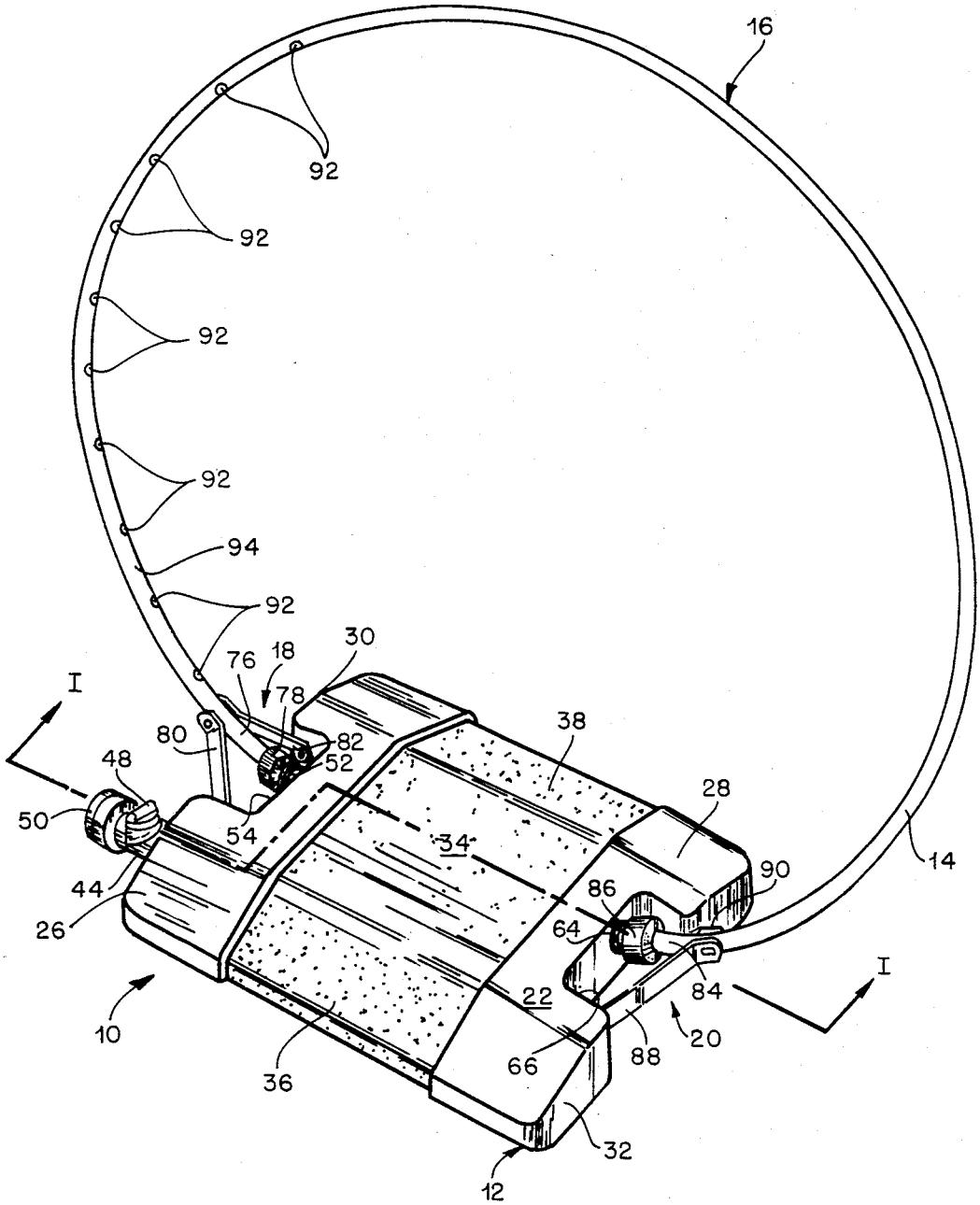
FIG. 1 is a perspective view of a spray hoop constructed in accordance with the present invention.
Figure 2:
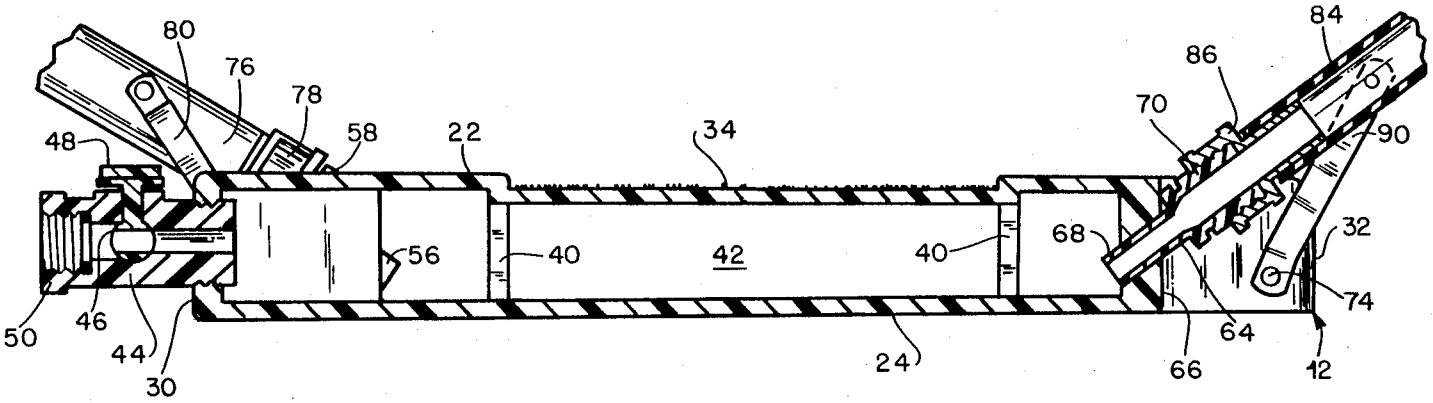
FIG. 2 is a cross-sectional view, taken along lines I—I in FIG. 1 and looking in the direction of the arrows, of the spray hoop of FIG. 1.
Figure 3:
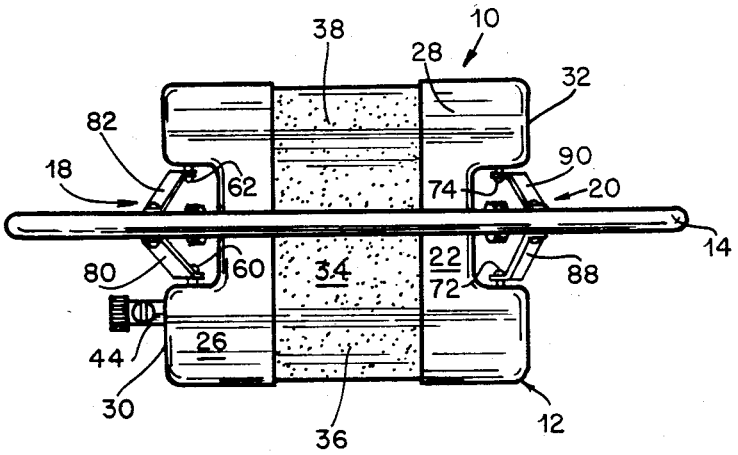
FIG. 3 is a top view of the spray hoop illustrated in FIG. 1.
Figure 4:
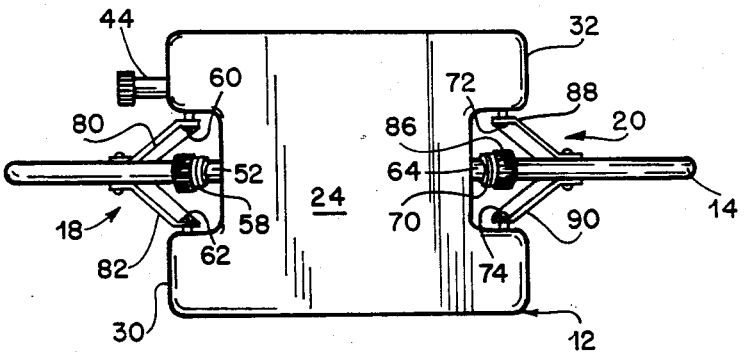
FIG. 4 is a bottom view of the spray hoop shown in FIG. 1.

Referring to FIGS. 1–4, there is shown a spray hoop 10 including a plastic base 12 and a semi-rigid plastic hose 14 which is bent into a generally vertically arranged hoop 16 sized and shaped to permit an individual, such as a child, to run therethrough. Locking mechanisms 18, 20 cooperate with each other to maintain the hoop 16 formed by the hose 14 in a generally vertical position.

The base 12 includes a substantially flat top wall 22, a flat bottom wall 24, a pair of inclined sidewalls 26, 28 and a pair of end walls 30, 32. The top wall 22 and the sidewalls 26, 28 are provided with adjoining anti-skid surfaces 34, 36, 38, respectively, designed to inhibit an individual who is running through the hoop 16 from slipping on the base 12. The sidewalls 26, 28 are inclined to reduce the possibility that an individual who is running through the hoop 16 will trip on the base 12.

Except for a plurality of supporting ribs 40, the base 12 is completely hollow so as to form an interior chamber 42 therein. The supporting ribs 40 rigidify the base 12 to prevent its collapse under the weight of an individual who steps on the base 12 while running through the hoop 16. The interior chamber 42 has a capacity sufficient to retain enough water, about one and one half gallons or approximately twelve pounds, to stabilize the spray hoop 10 and thereby inhibit the spray hoop 10 from being inadvertently tipped over.

An inlet fitting 44 is located in the end wall 30 of the base 12 for supplying water to the interior chamber 42. The inlet fitting 44 includes a shutoff valve 46 which can be rotated manually by a control knob 48 between an on position and an off position for regulating the flow of water through the inlet fitting 44 and, hence, into the interior chamber 42 of the base 12. An outer end 50 of the inlet fitting 44 is internally threaded so that it can receive a standard garden hose (not shown).

An outlet fitting 52 is positioned in a U-shaped notch 54 formed in the end wall 30 of the base 12. An inner end 56 of the outlet fitting 52 is in constant fluid communication with the interior chamber 42 of the base 12. An outer end 58 of the outlet fitting 52 is externally threaded. The notch 54 also includes locking pins 60, 62.

Another outlet fitting 64 is positioned in a U-shaped notch 66 formed in the end wall 32 of the base 12. An inner end 68 of the outlet fitting 64 is in constant fluid communication with the interior chamber 42 of the base 12. An outer end 70 of the outlet fitting 64 is externally threaded. The notch 66 also includes locking pins 72, 74.

One end 76 of the hose 14 is provided with an internally threaded coupling member 78 and locking brackets 80, 82, which are pivotally attached to the hose 14. The coupling member 78 threadedly and releaseably receives the externally threaded outer end 58 of the outlet fitting 52 so that the end 76 of the hose 14 is in constant fluid communication with the interior chamber 42 of the base 12. The locking bracket 80 includes a hole (not shown) sized and shaped so as to releaseably receive the locking pin 60 on the base 12. Similarly, the locking bracket 82 includes a hole (not shown) sized and shaped so as to releaseably receive the locking pin 62 on the base 12. The locking pins 60, 62 and the locking brackets 80, 82 form the locking mechanism 18.

An opposite end 84 of the hose 14 is provided with an internally threaded coupling member 86 and locking brackets 88, 90, which are pivotally attached to the hose 14. The coupling member 86 threadedly and releaseably receives the externally threaded outer end 70 of the outlet fitting 64 so that the end 84 of the hose 14 is in constant fluid communication with the interior chamber 42 of the base 12. The locking bracket 88 includes a hole (not shown) sized and shaped so as to releaseably receive the locking pin 72 on the base 12. Similarly, the locking bracket 90 includes a hole (not shown) sized and shaped so as to releaseably receive the locking pin 74 on the base 12. The locking pins 72, 74 and the locking brackets 88, 90 form the locking mechanism 20.

The hose 14 includes a plurality of orifices 92 spaced at intervals along an inner circumferential surface 94 of the hose 14. The orifices 92 are designed to direct water radially inward relative to the hoop 16 formed by the hose 14 to spray individuals who run or otherwise pass through the hoop 16.

In order to assemble the spray hoop 10, the hose 14 is attached to the base 12 by threading the coupling members 78, 86 onto the outlet fittings 52, 64, respectively, whereby the hose 14 is bent to form the generally vertically arranged hoop 16. The locking brachets 80, 82 are then applied to the locking pins 60, 62, respectively, while the locking brackets 88, 90 are applied to the locking pins 72, 74, respectively, so that the hoop 16 is releaseably maintained in its generally vertical position. Next, a garden hose connected to a source of water, such as a faucet, is threadedly attached to the inlet fitting 44 with the shutoff valve 46 in its closed position.

In operation, after turning on the faucet, the shutoff valve 46 is opened to permit the water in the garden hose to flow into the spray hoop 10, where it flows along a generally circular path which includes the hose 14 and the interior chamber 42 of the base 12. The water flowing through the hose 14 is discharged from the orifices 92 in the form of a spray. In order to regulate the discharge of water from the orifices 92, the control knob 48 can be manually rotated to adjust the position of the shutoff valve 46 and, hence, the flow of water therethrough.

It will be understood that the embodiment described herein is merely exemplary and that a person skilled in the art may make many variations and modifications without departing from the spirit and scope of the invention. For instance, the number, size and location of the orifices 92 may be varied to achieve a variety of different spray patterns. All such modifications and variations are intended to be included within the scope of the invention as defined in the appended claims.

I claim:

1. A spray hoop, comprising a base including an interior chamber of a capacity sufficient to retain enough water to stabilize said spray hoop, an inlet located at one end of said base in fluid communication with said interior chamber thereof, a manually adjustable valve positioned in said inlet, a first outlet located at said one end of said base in fluid communication with said interior chamber thereof, and a second outlet located at an opposite end of said base in fluid communication with said interior chamber thereof; a semi-rigid hose connected between said first and second outlets of said base such that said hose is bent into a generally vertically arranged hoop which is in constant fluid communication with said interior chamber of said base when said hose is connected between said first and second outlets and which is sized and shaped to permit an individual to pass therethrough when said hose is connected between said first and second outlets of said base, said hose including a plurality of orifices spaced at intervals along an inner circumferential surface of said hose, each of said orifices directing water radially inward relative to the hoop formed by said hose to thereby spray an individual running through the hoop; and locking means for releaseably locking the hoop formed by said hose in a generally vertical position.

2. A spray hoop according to claim 1, wherein the capacity of said interior chamber of said base is approximately one and one half gallons.

3. A spray hoop according to claim 1, wherein said locking means includes a first pair of locking pins positioned at said one end of said base and a first pair of locking brackets pivotally attached to one end of said hose, each locking bracket of said first pair of locking brackets being releaseably engageable with a corresponding one of said locking pins of said first pair of locking pins, a second pair of locking pins positioned at said opposite end of said base and a second pair of locking brackets pivotally attached to an opposite end of said hose, each locking bracket of said second pair of locking brackets being releaseably engageable with a corresponding one of said locking pins of said second pair of locking pins.

4. A spray hoop according to claim 1, wherein said base includes a substantially flat top wall and a pair of inclined sidewalls, said top wall and said sidewalls being provided with adjoining anti-skid surfaces.

* * * * *